US008898863B2

(12) United States Patent
Van Doorn

(10) Patent No.: US 8,898,863 B2
(45) Date of Patent: Dec. 2, 2014

(54) AXIAL SAW COTTON SEED RECLAIMER

(71) Applicant: Lummus Corporation, Pooler, GA (US)

(72) Inventor: Donald William Van Doorn, Pooler, GA (US)

(73) Assignee: Lummus Corporation, Pooler, GA (US)

( * ) Notice: Subject to any disclaimer, the term of this patent is extended or adjusted under 35 U.S.C. 154(b) by 65 days.

(21) Appl. No.: 13/633,438

(22) Filed: Oct. 2, 2012

(65) Prior Publication Data

US 2014/0090207 A1 Apr. 3, 2014

(51) Int. Cl.
*D01B 1/08* (2006.01)

(52) U.S. Cl.
CPC ..... *D01B 1/08* (2013.01)
USPC ..... 19/55 R

(58) Field of Classification Search
USPC ..... 19/54, 55 R, 63, 114
See application file for complete search history.

(56) References Cited

U.S. PATENT DOCUMENTS

| | | | | | |
|---|---|---|---|---|---|
| 4,054 | A * | 5/1845 | Ely | 19/54 |
| 986,415 | A * | 3/1911 | White | 19/41 |
| 1,038,927 | A * | 9/1912 | McCormick | 19/54 |
| 1,811,549 | A * | 6/1931 | Langer | 19/83 |
| 2,194,462 | A * | 3/1940 | Mitchell, Jr. et al. | 19/35 |
| 2,715,809 | A * | 8/1955 | Buell | 56/28 |
| 3,467,991 | A * | 9/1969 | Gray | 19/203 |
| 3,955,346 | A * | 5/1976 | Coon | 56/28 |
| 3,988,806 | A * | 11/1976 | Bledsoe | 19/203 |
| 4,390,376 | A * | 6/1983 | Rood, Jr. | 134/6 |
| 4,497,088 | A * | 2/1985 | Lehman | 19/202 |
| 4,625,366 | A * | 12/1986 | Egerer | 19/97 |
| 4,821,496 | A * | 4/1989 | Kysar | 56/28 |
| 4,974,293 | A * | 12/1990 | Baker | 19/40 |
| 4,984,334 | A * | 1/1991 | Wilkes et al. | 19/48 R |
| 5,038,440 | A * | 8/1991 | Demuth et al. | 19/114 |
| 5,392,495 | A * | 2/1995 | Horn | 19/55 R |
| 6,148,594 | A * | 11/2000 | Heaton et al. | 56/28 |
| 6,421,991 | B1 * | 7/2002 | Goering et al. | 56/28 |
| 6,449,804 | B1 * | 9/2002 | Van Doorn | 19/48 R |
| 6,546,709 | B2 * | 4/2003 | Goering et al. | 56/28 |
| 6,640,530 | B1 * | 11/2003 | Arbuckle | 56/130 |
| 2002/0069632 | A1 * | 6/2002 | Goering et al. | 56/28 |
| 2010/0306966 | A1 * | 12/2010 | Van Doorn | 19/205 |

* cited by examiner

*Primary Examiner* — Shaun R Hurley
(74) *Attorney, Agent, or Firm* — Robert J. Veal

(57) ABSTRACT

A reclaimer cylinder for use in reclaiming cotton seeds containing spinnable lint from partially ginned cotton seeds utilizes channel saws mounted axially on a cylindrical body with axially closely spaced teeth that virtually eliminate the variation in likelihood the teeth will fail to grasp the fibers present on such cotton seeds. Triangular grid bars facilitate removal of fully ginned seeds that are not entrained in fibers of other seeds.

15 Claims, 5 Drawing Sheets

AXIAL SAW COTTON SEED RECLAIMER

BACKGROUND OF THE INVENTION

The present invention relates to the field of raw cotton fiber and cotton seed processing. In the cotton processing industry, a saw is not a device for cutting into a material, but rather it is a device that has sharply pointed teeth for grasping the cotton fibers. The early "saw" gins used discs with sharp teeth around their peripheries that resembled circular saws, which probably is how the name, "saw" originated. Later, as seed cotton (cotton before ginning) was brought to the gins containing more and more extraneous matter, including the cotton hulls, machines were developed to extract this foreign matter, and these machines became known as "extractors".

A common element in such extractor machines is a "channel saw." Referring to FIGS. 1 to 4, the channel saw 11 is a thin metal strip formed into a right angle channel shape with sharp teeth 12 formed in rows 13 on the edges of the two equal legs of the channel shape. These outwardly opening channels are formed into arcs defined by the circumference of the cylinder 14 onto which the channel saws are to be peripherally mounted as shown in FIG. 2. Thus the channel runs perpendicular to the axis of rotation of the cylinder. These channel saws are about ½" wide between the legs and are mounted about ½" apart axially on the surface of the extractor machine cylinder. This spacing has proven to be efficient in extracting the large foreign matter from the seed cotton locks before ginning removing the fibers from the seeds.

Recently there have been developments in roller ginning that have increased the roller gin's ginning rate to near the rate of the saw gin. The roller ginning process has been proven to break fewer fibers than saw ginning, thus to make the fiber more valuable to the textile mills. Roller ginning has largely been confined to the relatively small extra long staple cotton varieties such as Pima because of the slow, more expensive roller ginning process. With the recent ginning rate increase of roller ginning, the better quality of roller ginned cotton should open the much larger upland cotton market to roller ginning. However, while the saw ginning process can adequately control the uniformity of the fiber remaining on the seeds, the roller ginning process must depend on "seed reclaimers" to retrieve the seeds with valuable fiber left on them from the seeds that are properly ginned and send the seed with valuable fiber back for further ginning. That is to say, the reclaimer removes un-ginned and partially-ginned seeds from a seed flow and directs them to a further lint removal process.

The increase in roller ginning rate, of course, must be accompanied by an increase in the rate of seed reclaimers to be successful. While the saw extractor technology of the prior art as described above shows promise for use in seed reclaimers, the efficiency of the current standard circumferentially extending extractor saws is not adequate. The seeds leaving the reclaimers that are to be sent to the properly ginned seed bin contain too many seeds with good fiber on them and the seeds that are to be returned for further ginning have too many already well ginned seeds. It should be understood that the output of a cotton gin stand has three components: the spinnable cotton fiber (lint), which is the most valuable component; the cotton seeds from which the fiber has been removed by the ginning process, which is salable at a lower rate than the fiber; and, the trash which was entrained with the seed cotton and has been extracted. When cotton seeds with ginnable fiber still on them are discharged with the well ginned seed component, the unginned fiber is sold at the rate of the seed, or worse, the fiber lowers the seed value for the sale to the dairy industry, thereby creating an inefficiency. Likewise, when the ginned seeds are discharged with the trash, the value of the seed is lost, yielding further inefficiency. It should be understood that cotton gin plants have many seed cotton cleaners (before the ginning process) that use spiked cleaning cylinders that convey seed cotton over spaced apart grid bars or coarse screens that are sized to allow optimum trash removal without allowing full seed locks to pass through the grids or screens. When partially or fully ginned seed pass over these grids or screens, there are often too few fibers on the seeds to prevent the seeds from falling out with the trash.

It is an object of the present invention to increase the processing rate of roller ginning of upland and pima cotton. It is a further object of the invention to more efficiently return cotton seeds having recoverable fiber attached thereto to the gin stand for further ginning. It is a concomitant object to eject well ginned seeds such that they do not return to the gin nor to the trash.

These and other objects and advantages of the invention will become apparent from the following detailed description of the preferred embodiment of the invention.

BRIEF DESCRIPTION OF THE DRAWINGS

An apparatus for processing cotton seed is depicted in the accompanying drawings which form a portion of this disclosure and wherein.

DESCRIPTION OF THE PREFERRED EMBODIMENT

Figure 2:
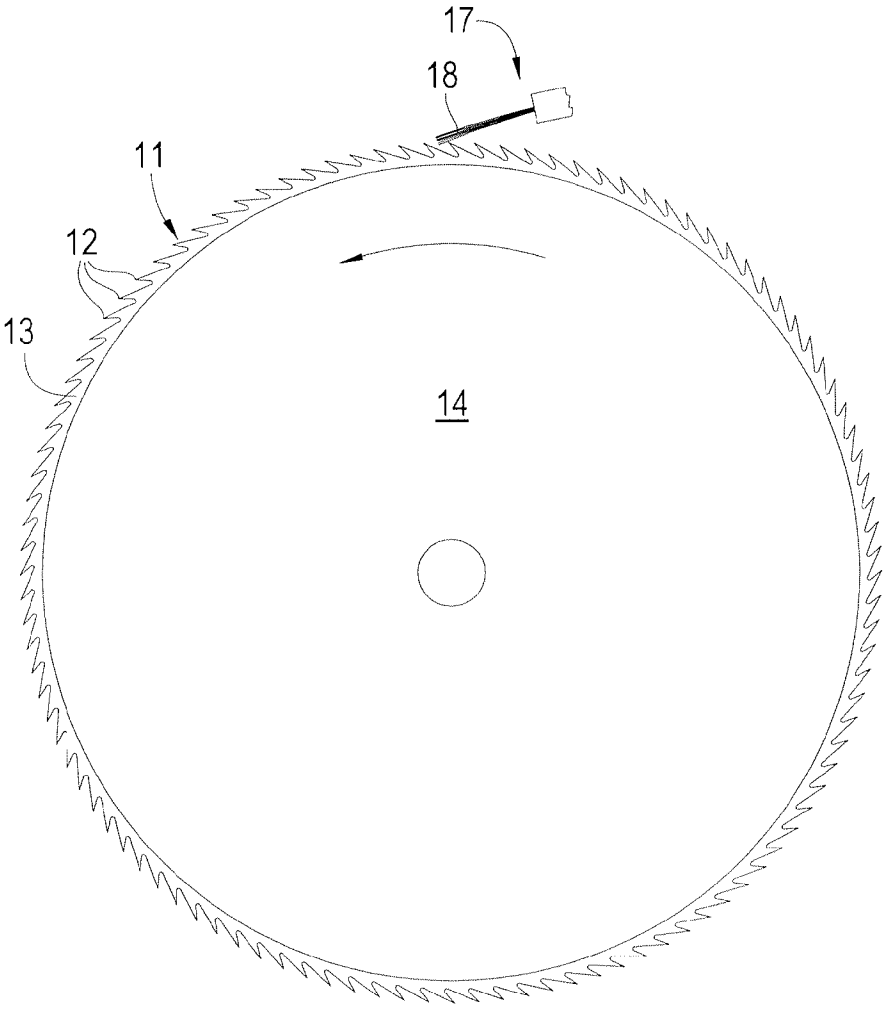
FIG. 2 Prior Art
FIG. 2 is an end view of the prior art saw shown in FIG. 1
Figure 1:
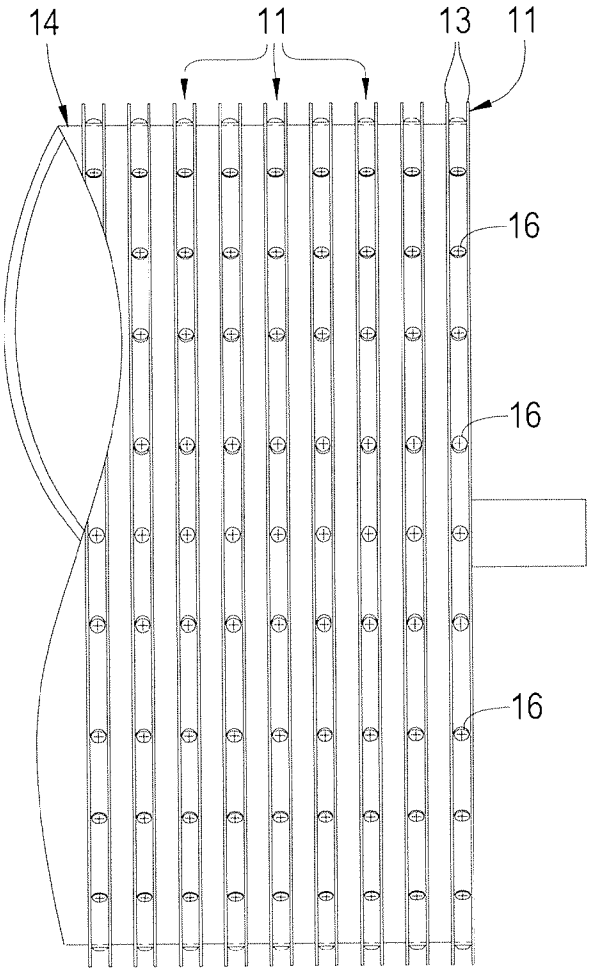
FIG. 1 Prior Art
FIG. 1 is a side elevation view depicting the prior art reclaimer saw.
Figure 4:
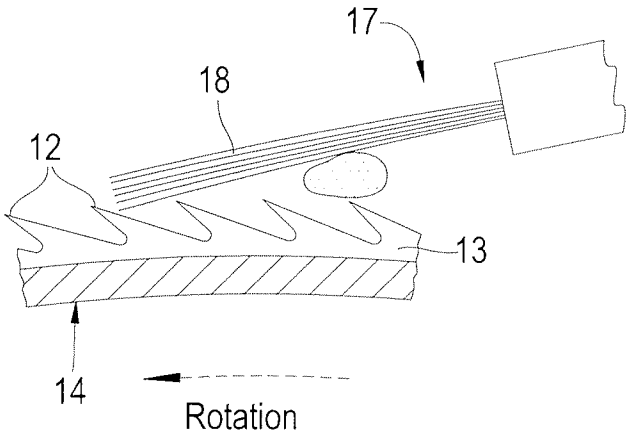
FIG. 4 Prior Art
FIG. 4 is a cross sectional view of the prior art channel saw shown in FIG. 2 showing the profile of typical cotton seed.

Referring to the FIGS. 1-10 for a clearer understanding of the invention, it may be seen that the preferred embodiment of the invention contemplates a new saw profile and a new orientation of the saw profile.

Referring to FIGS. 3, 4, 7 and 8, note the comparative views of the current standard extractor saw and the axial reclaimer saw of my invention along with the profiles of typical cotton seeds. In each figure note that a cylinder 14 or 14' is mounted for driven rotation about its axis. The standard channel saw presents parallel rows 13 of teeth 12 extending around cylinder 14 and spaced about ½ inch apart. The rows 13 cannot be much closer because screw head 16 is seated with in the channel to attach the saw to cylinder 14. In FIGS. 5 to 8, note that the illustrated embodiment of the present invention utilizes channel saws 11' with rows 22 of teeth 23 affixed to the cylinder 14' and extending axially along the outer surface of cylinder 14'.

Figure 3:
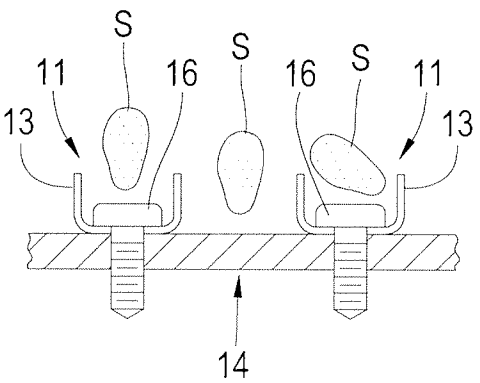
FIG. 3 Prior Art
FIG. 3 is a sectional view of the prior art reclaimer saw shown in FIG. 1 showing the profiles of typical cotton seeds.
Figure 6:
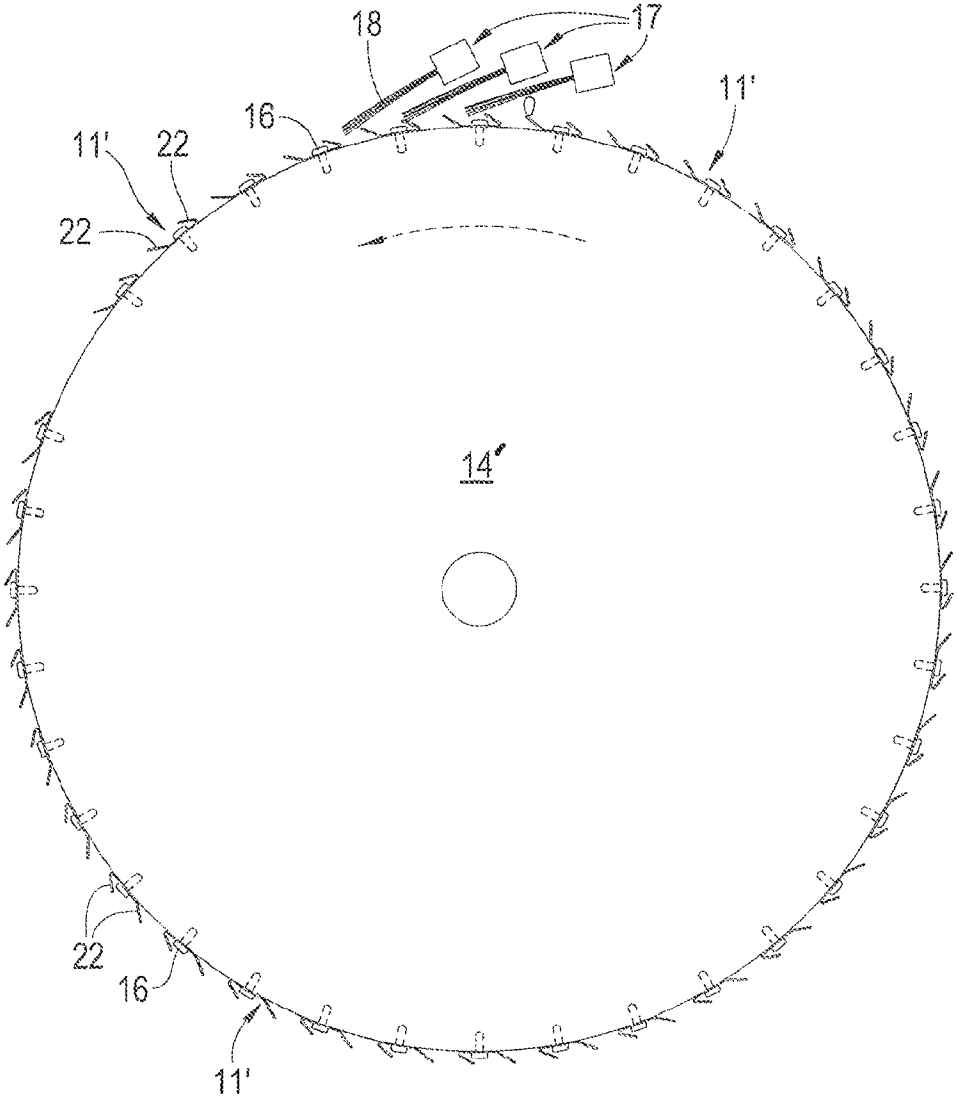
FIG. 6 is an end view of an embodiment of the present invention.
Figure 7:
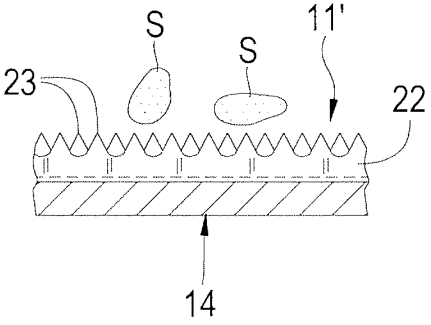
FIG. 7 is a partial sectional side elevational view of an embodiment of the present invention showing profiles of typical cotton seeds.

The efficiency of the reclaimer process is dependent upon the certainty of the reclaimer saws grasping and holding the seeds with valuable fiber attached while centrifugal forces and grid bars 44 around the reclaimer cylinders are efficiently designed to expel the seeds without significant amounts of valuable fiber attached. FIGS. 3 and 7 most clearly illustrate the comparative certainty of a seed being grasped and held by the standard extractor saw as compared to the axial reclaimer saw of my invention. The roller gin process often strips only one side of a seed S, leaving a profile of less than ½", that is to say, a profile less than the spacing between the prior art saws. It also should be understood that in the conventional extractor process the seeds are applied to the extractor saw teeth by stationary brushes 17 with bristles 18 about 3" long that comb the fibers straight back, parallel to the saw movement. Thus, the conventional extractor saw teeth may not contact the fibers of some seeds with valuable fiber, let alone firmly grasp the fibers.

By contrast the teeth 23 of my axial channel saw may be made as close to each other axially as desired. Furthermore the teeth 23 of the of the two rows 22 formed by the channel may be offset axially to further increase the certainty of grasping the valuable fibers or increasing the grip of the combined teeth to allow more vigorous centrifugal forces and grid bar 44 designs to eject the seeds that are already properly ginned.

The significance of the different actions of the two saw structures needs to be fully understood. Significantly, the seed rotation with the reclaimer saw cylinder is caused primarily by the saw teeth grasping the fibers attached to the seeds, however some seeds are just entrained with seeds that are impaled on the saw teeth, thus these entrained seed are not grasped by the saw teeth. Some of the seeds being presented to the reclaimer saw teeth are already adequately ginned and therefore must depend upon being entrained by the seeds impaled on the saw teeth or to a lesser extent, the paddle effect of the bare saws themselves as these seeds don't have enough long fiber to be grasped by the teeth. These seeds are free to properly be ejected by centrifugal force and grid bar action unless they are entrapped under seeds that are impaled on the saw teeth. Here the advantage of the axial reclaimer saw becomes apparent. Whereas the current extractor saws with their ½" axial spacing have at best only three teeth 12 per inch axially to grasp and hold the seeds with long fibers, my axial channel reclaimer saw can have as many teeth 23 axially as is practical to punch, say eight or ten per inch per leg of the axial channel. The axial channel has two legs spaced a little over ½" apart which may be offset axially one half a tooth space to offer sixteen or twenty teeth axially to grasp the long fibers for every angular saw cylinder surface movement of a little over one inch. The channels may be spaced apart on the cylinder surface by ½" for uniform spacing of the legs of the channels, or the separation may be varied. As may be seen in FIGS. 5 to 8 of the present embodiment the leg of the channel and the teeth formed there on preferentially extend at an acute angle from the tangent line at the surface of the drum, such that the teeth are angled toward the direction of rotation. Preferably the legs and corresponding teeth are inclined toward the direction of rotation of the saw cylinder at an angle of about 60 degrees from a line normal to the surface of said cylinder. The teeth may be inclined at about 35 degrees from the tangent line of the cylinder, thus, an appropriate range would be about 30 to 35 degrees from the tangent line of the surface of the cylinder.

The stationary brush 17 extends axially from end to end of the seed reclaimer machine and has very uniform bristles 18. The bristles 18 uniformly press the axially randomly located seed with attached fiber onto the saw teeth or spaces axially between the teeth without moving the seed axially, but perhaps combing the fibers on the seeds back into the spaces behind the seeds. In an alternative embodiment, the use of more than one stationary brush in series further increases the likelihood of the saw teeth grasping or more firmly holding the seeds with long fibers attached. A second or third stationary brush could physically "roll back" seeds not already firmly grasped, to the next axial row of teeth. Mounting surfaces in the housing are used to mount two and even three stationary brush sticks at thirty to forty-five degrees from tangent to the saw surface just ahead of the first grid bar. This inexpensive addition could help assure that the seeds with significant long fibers attached are firmly impaled on the reclaimer saw teeth and help insure that the seeds with insignificant amounts of long fiber are brushed free of the seeds impaled on the reclaimer teeth and swept free of the reclaimer teeth themselves. Also the additional combing action of the added stationary brushes potentially would free the well ginned seed entrapped under the seeds with fibers attached clinging to the saw teeth or uncover the well ginned seed trapped in an uneven surge of seeds, thus making the well ginned seed free to move outward by centrifugal force.

Since the seeds present profiles from about 3/16" to 3/8" wide, the prior art reclaimer saws will grasp almost 100% of the seeds with fibers attached which are aligned with a circumferential row 13 of teeth, and fewer of the seeds that are aligned with the spaces (½" wide) between the rows 13. Even the seeds aligned with the saw teeth will have only a narrow band of fibers grasped by the saw teeth because the teeth 12 are aligned in a row 13 with no significant extension parallel the axis of rotation.

Figure 5:
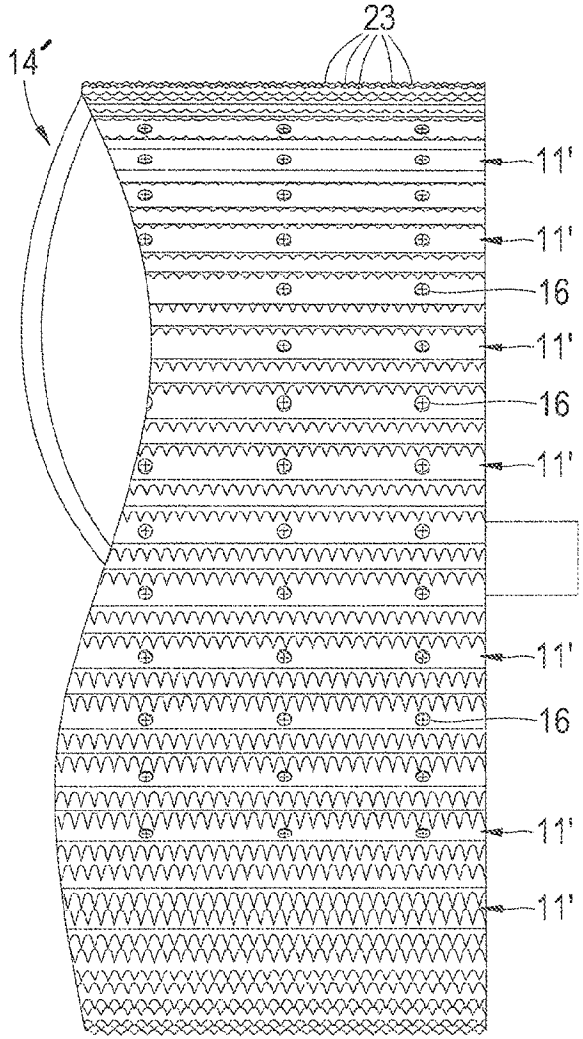
FIG. 5 is a side elevational view depicting an embodiment of the axially aligned saw of the current invention.
Figure 9:
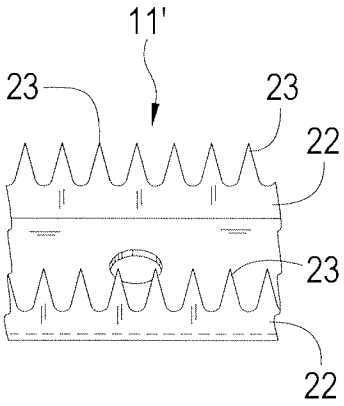
FIG. 9 is a projection along line 9-9 of FIG. 8 showing the offset orientation of the axially aligned saw teeth.
Figure 8:
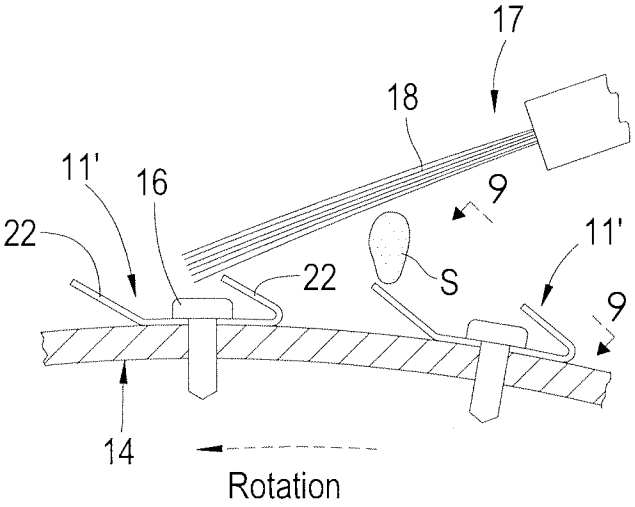
FIG. 8 is a partial sectional end view of the embodiment shown in FIG. 6 along with the profiles of typical cotton seeds.

By contrast the reclaimer saws of my axial channels have axially closely spaced teeth 23 as shown in FIGS. 5, 7 & 9 that virtually eliminate the variation in likelihood the teeth 23 will grasp the fibers. Furthermore the axially closely spaced teeth 23 of my axial channels will grasp a wide band of fibers, at least the width of the seed profile, that the stationary brushes 17 press onto the saw teeth. Accordingly the teeth 23 not only uniformly grasp the seed with fiber attached, but the embodiment greatly increases the number of teeth 23 holding the seed to allow use of more vigorous forces to eject the well ginned seed without losing seed needing further ginning. The angular (peripheral) tooth spacing of my axial channel is greater than that of the current extractor channel and furthermore, my axial channel saws may be mounted farther apart peripherally. Neither structure should have a problem with processing rate, but there is a large difference in the firmness of the grip of the teeth holding the seed with fibers attached. The somewhat wider angular spacing of the axial rows of teeth of my axial channels along with the variable peripheral spacing of the axial channels may be helpful in freeing the well ginned seed that may be entrapped under the seeds with long fiber attached that are clinging to the axial rows 22 of teeth 23. My axial channel, with its superior fiber grip, should be accompanied with faster reclaimer cylinder rotational speeds to increase the centrifugal forces needed to eject the properly ginned seed. This, of course, should also increase the potential processing rate.

Figure 10:
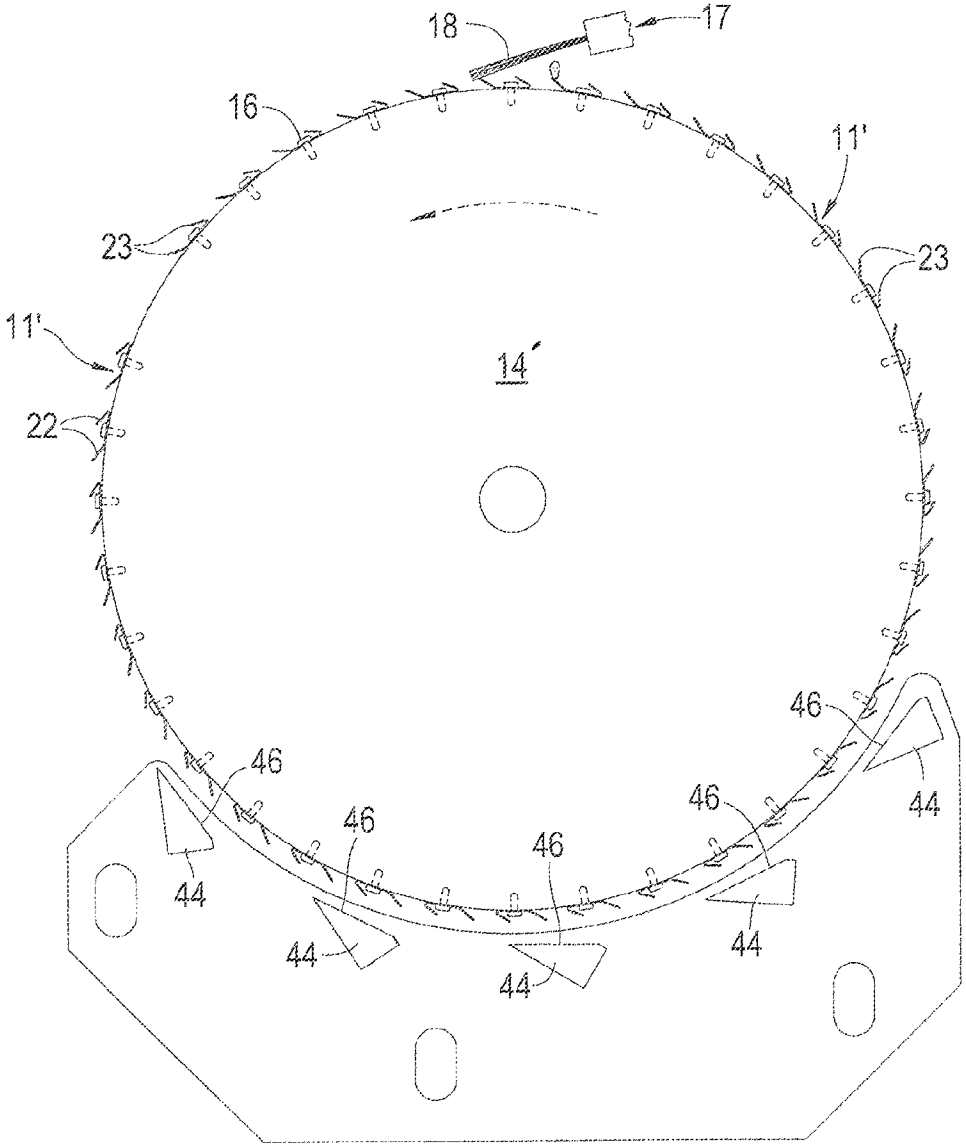
FIG. 10 is an end view of the saw cylinder and support panel carrying the grid bars of the embodiment shown in FIG. 6.

Further, as shown in FIG. 10, the reclaimer of the proposed embodiment uses new grid bars 44 of an improved design. Specifically, prior art grid bars were generally tubular having a round cross-section. The new grid bars 44 are substantially triangular with a linear surface 46 proximal and spaced from the line of travel of the tips of teeth 23 such that the linear surface 46 extends substantially along a plane that would be parallel to the tangent plane of the teeth on the cylinder. Therefore the line of travel of the teeth 23 diverges from the linear surface such that cotton seed which does not have fiber grasped by the teeth 23 nor entrained with the fiber from other seed is ejected without interference from the surface in the interstices between grid bars. The number of grid bars and their spacing is empirically dependant upon rotational speed and the quantity and length of cotton fibers remaining on the reclaimed seed. The apex of the grid bars 44 will be rounded sufficiently to avoid damaging seed as it passes between the grid bars and the cylinder.

It is to be understood that the form of the invention shown is a preferred embodiment thereof and that various changes and modifications may be made therein without departing from the spirit of the invention or scope as defined in the following claims.

What is claimed is:

1. A saw cylinder for a cotton ginning reclaimer wherein cotton seeds with spinnable fibers remaining thereon are separated from a commingled flow with cotton seed that have few or no spinnable fibers remaining thereon comprising: a cylindrical body mounted for driven rotation about a longitudinal axis extending there through; and, a plurality of channel saws comprising metal channel shaped strips mounted axially along the outer surface of said cylinder in spaced relation to each other circumferentially about said cylinder by a distance greater than one average seed length, each of said channel strips having sharp teeth along the edges of their legs such that said teeth are less than one average seed diameter apart.

2. A saw cylinder as described in claim 1 wherein said teeth are inclined toward the direction of rotation of said saw cylinder.

3. A saw cylinder as described in claim 2 wherein said teeth are inclined toward the direction of rotation of the saw cylinder at an angle of about 60 degrees from a line normal to the surface of said cylinder.

4. A saw cylinder as described in claim 1, wherein said channel saws are equidistantly spaced apart about said cylinder.

5. A saw cylinder for a cotton ginning reclaimer comprising: a cylindrical body mounted for driven rotation about a longitudinal axis extending there through; and, a plurality of channel saws mounted axially along the outer surface of said cylinder wherein said channel saws are spaced apart about said cylinder such that said channel saws are not equidistant.

6. A saw cylinder as described in claim 5, wherein said channel saws are spaced in a pattern of varying separations.

7. A cotton ginning reclaimer utilizing a saw cylinder as claimed in claim 1 further comprising a plurality of grid bars mounted in spaced relation to each other extending axially parallel to the axis of rotation of said saw cylinder and having a linear surface proximal and offset from said cylinder and extending substantially parallel to a plane tangent said cylinder at its leading edge relative to the cylinder rotation.

8. A cotton ginning reclaimer as set forth in claim 7 wherein said grid bars are generally triangular.

9. A saw cylinder as described in claim 1, wherein said channel saws are inclined in the direction of rotation of said cylinder at an angle of about 35° from a tangent of the cylinder.

10. A saw cylinder as described in claim 1, wherein said channel saws include a base affixed to said cylindrical body, a first linear row of spaced apart teeth extending from said base along one edge thereof and a second linear row of similarly spaced apart teeth extending from an opposite side of said base, wherein the teeth of said second row are offset linearly from the teeth of said first row by approximately one half the spacing between teeth.

11. Apparatus for separating cotton seeds with spinnable fibers remaining on them from cotton seeds that are well ginned, moving comingled in a flow, said apparatus comprising a cylinder rotatable about its longitudinal axis onto which metal channel shaped strips are axially mounted side by side circumferentially, the channel strips having sharp teeth along the edges of their outwardly facing legs, said teeth being spaced apart less than one average seed diameter and said channel legs being spaced apart greater than one average seed length both from adjacent channels and within a common channel strip.

12. Apparatus as defined in claim 11 wherein said cylinder is mounted in a housing with stationary grid bars circumferentially spaced adjacent said channel saw for ejecting seeds without sufficient spinnable fiber to hold the seed to the teeth of the axial saws.

13. Apparatus as defined in claim 12 wherein said housing supports a rotating doffing cylinder located adjacent said cylinder angularly offset from said grids to recover separated seeds with spinnable fiber.

14. Apparatus as defined in claim 12 wherein said stationary grid bars are mounted in spaced relation to each other extending axially parallel to the axis of rotation of said saw cylinder and having a linear surface proximal and offset from said cylinder and extending substantially parallel to a plane tangent said cylinder at its leading edge relative to the cylinder rotation.

15. A cotton gin reclaimer as described in claim 7 in which said grid bar surfaces away from the cylinder extend from said leading edge substantially parallel to planes from 30 degrees to 45 degrees from tangent to the cylinder as the grid bars are in an arc partially around the cylinder.

* * * * *